US009500045B2

(12) United States Patent
Kuttel et al.

(10) Patent No.: US 9,500,045 B2
(45) Date of Patent: Nov. 22, 2016

(54) RECIPROCATING AND ROTATING SECTION AND METHODS IN A DRILLING SYSTEM

(71) Applicant: Canrig Drilling Technology Ltd., Houston, TX (US)

(72) Inventors: Beat Kuttel, Spring, TX (US); Lemuel T. York, Montgomery, TX (US); Faisal J. Yousef, Houston, TX (US); Keith A. Hager, Spring, TX (US); Randy Slocum, Houston, TX (US)

(73) Assignee: Canrig Drilling Technology Ltd., Houston, TX (US)

( * ) Notice: Subject to any disclaimer, the term of this patent is extended or adjusted under 35 U.S.C. 154(b) by 406 days.

(21) Appl. No.: 14/056,540

(22) Filed: Oct. 17, 2013

(65) Prior Publication Data

US 2014/0116781 A1 May 1, 2014

Related U.S. Application Data

(60) Provisional application No. 61/784,381, filed on Mar. 14, 2013, provisional application No. 61/720,725, filed on Oct. 31, 2012.

(51) Int. Cl.

| | |
|---|---|
| ***E21B 7/00*** | (2006.01) |
| ***E21B 17/07*** | (2006.01) |
| ***E21B 17/03*** | (2006.01) |

(52) U.S. Cl.

CPC ..... *E21B 17/07* (2013.01); *E21B 17/03* (2013.01)

(58) Field of Classification Search

USPC ..... 175/57, 324

See application file for complete search history.

(56) References Cited

U.S. PATENT DOCUMENTS

| | | | |
|---|---|---|---|
| 2,240,519 | A | 5/1941 | Reed |
| 2,756,966 | A | 7/1956 | Bassinger |
| 3,970,335 | A | 7/1976 | Curington et al. |
| 4,393,932 | A | 7/1983 | Bodine |
| 4,429,743 | A | 2/1984 | Bodine |

(Continued)

FOREIGN PATENT DOCUMENTS

| | | |
|---|---|---|
| WO | WO 2004/051004 | 6/2004 |
| WO | WO 2010/089572 | 8/2010 |

OTHER PUBLICATIONS

CKD Corporation, "Pneumatic Cylinders" http://www.ckd.co.jp/english/kiki/info/cylinder/rodless.htm, visited Oct. 17, 2013, 2 pages.

(Continued)

*Primary Examiner* — Taras P Bemko

(74) *Attorney, Agent, or Firm* — Haynes & Boone, LLP

(57) ABSTRACT

An apparatus including a stationary section having a first central fluid passage and operably connected to a drilling fluid inlet and a conduit, a rotating and reciprocating section having a second central fluid passage and operably connected to a tubular, wherein the rotating and reciprocating section reciprocates along a longitudinal axis and rotates in conjunction with the tubular and the conduit, and a third section having a third central fluid passage in fluid communication between the first and second central fluid passages, where the third section is operably disposed between the first and rotating and reciprocating sections to permit the rotating and reciprocating section to slide axially even during rotation and to permit only rotational motion at an end adjacent the stationary section.

23 Claims, 11 Drawing Sheets

(56) References Cited

U.S. PATENT DOCUMENTS

| | | | |
|---|---|---|---|
| 4,474,249 | A | 10/1984 | Zahradnik et al. |
| 4,635,969 | A | 1/1987 | Jackson |
| 4,640,360 | A | 2/1987 | Bodine et al. |
| 4,791,997 | A | 12/1988 | Krasnov |
| 4,815,546 | A | 3/1989 | Haney et al. |
| 4,872,517 | A | 10/1989 | Shaw et al. |
| 5,098,135 | A | 3/1992 | Timm |
| 5,549,170 | A | 8/1996 | Barrow |
| 5,934,683 | A | 8/1999 | Sieghartner |
| 6,378,630 | B1 | 4/2002 | Ritorto et al. |
| 6,431,626 | B1 | 8/2002 | Bouligny |
| 6,443,247 | B1 | 9/2002 | Wardley |
| 6,474,421 | B1 | 11/2002 | Stoesz |
| 6,513,223 | B1 | 2/2003 | Angman et al. |
| 6,561,368 | B1 | 5/2003 | Sturm, Jr. et al. |
| 6,568,686 | B2 | 5/2003 | Hadley |
| 6,622,796 | B1 | 9/2003 | Pietras |
| 6,705,413 | B1 | 3/2004 | Tessari |
| 6,732,822 | B2 | 5/2004 | Slack et al. |
| 6,796,390 | B1 | 9/2004 | Bakker |
| 6,817,633 | B2 | 11/2004 | Brill et al. |
| 6,854,533 | B2 | 2/2005 | Galloway et al. |
| 6,857,487 | B2 | 2/2005 | Galloway et al. |
| 6,877,570 | B2 | 4/2005 | Chen et al. |
| 6,896,075 | B2 | 5/2005 | Haugen et al. |
| 6,899,186 | B2 | 5/2005 | Galloway et al. |
| 6,969,071 | B2 | 11/2005 | Berard |
| 7,013,997 | B2 | 3/2006 | Vail, III |
| 7,040,420 | B2 | 5/2006 | Vail, III |
| 7,044,241 | B2 | 5/2006 | Angman |
| 7,066,250 | B2 | 6/2006 | Webb et al. |
| 7,090,021 | B2 | 8/2006 | Pietras |
| 7,090,035 | B2 | 8/2006 | Lesko |
| 7,093,657 | B2 | 8/2006 | Johnson, Jr. |
| 7,147,068 | B2 | 12/2006 | Vail, III |
| 7,195,069 | B2 | 3/2007 | Roberts |
| 7,219,726 | B2 | 5/2007 | Zheng et al. |
| 7,275,605 | B2 | 10/2007 | Smith et al. |
| 7,320,374 | B2 | 1/2008 | Folk et al. |
| 7,341,116 | B2 | 3/2008 | Fincher et al. |
| 7,395,882 | B2 | 7/2008 | Oldham et al. |
| 7,409,758 | B2 | 8/2008 | Le et al. |
| 7,428,927 | B2 | 9/2008 | Vert et al. |
| 7,428,933 | B2 | 9/2008 | Miller et al. |
| 7,624,818 | B2 | 12/2009 | McClain et al. |
| 7,708,283 | B2 | 5/2010 | Azibert et al. |
| 7,730,965 | B2 | 6/2010 | Jordan et al. |
| 7,743,853 | B2 | 6/2010 | Rudshaug et al. |
| 7,748,445 | B2 | 7/2010 | Wells et al. |
| 7,748,473 | B2 | 7/2010 | Wells et al. |
| 7,748,474 | B2 | 7/2010 | Fincher et al. |
| 7,748,475 | B2 | 7/2010 | McClain et al. |
| 7,789,161 | B2 | 9/2010 | Riley et al. |
| 7,845,408 | B2 | 12/2010 | Robichaux et al. |
| 7,900,716 | B2 | 3/2011 | Ibrahim et al. |
| 8,006,785 | B2 | 8/2011 | Oldham et al. |
| 8,042,623 | B2 | 10/2011 | Quernheim et al. |
| 8,210,268 | B2 | 7/2012 | Heidecke et al. |
| 8,261,857 | B2 | 9/2012 | Able et al. |
| 2004/0003490 | A1 | 1/2004 | Shahin et al. |
| 2004/0112640 | A1* | 6/2004 | Hay ..... E21B 7/062 175/26 |
| 2005/0206090 | A1 | 9/2005 | Bunn |
| 2005/0242512 | A1 | 11/2005 | Findall |
| 2006/0000643 | A1 | 1/2006 | Jenkins |
| 2007/0251705 | A1 | 11/2007 | Wells et al. |
| 2008/0251254 | A1 | 10/2008 | Lynde et al. |
| 2008/0251257 | A1 | 10/2008 | Leuchtenberg |
| 2008/0264648 | A1 | 10/2008 | Pietras |
| 2009/0107675 | A1 | 4/2009 | Eriksen et al. |
| 2009/0151934 | A1* | 6/2009 | Heidecke ..... E21B 3/02 166/250.01 |
| 2010/0193198 | A1 | 8/2010 | Murray et al. |
| 2010/0206584 | A1* | 8/2010 | Clubb ..... E21B 19/08 166/380 |
| 2010/0212901 | A1 | 8/2010 | Buytaert |
| 2010/0288484 | A1 | 11/2010 | Robichaux et al. |
| 2011/0132594 | A1* | 6/2011 | Slack ..... E21B 19/06 166/77.51 |

OTHER PUBLICATIONS

Dan H. Reudelhuber et al., "The Diamond Coring System Phase II (4500 M Depth Capability)", Proceedings of the Ocean Drilling Program, Initial Reports, vol. 132, 1991, pp. 139-162.

Honda Worldwide, "A 4-Stroke Engine: The Natural Choice for a Comeback" http://world.honda.com/history/challenge/1979pistonengine/text/01.html, visited Oct. 17, 2013, 9 pages.

Kaila Engineering PVT Ltd, "Pneumatics" http://www.kailaengg.com/pneumatics/, 2013, 4 pages.

Rexroth, "RTC—Rodless Cylinders with Trend Setting Product Architecture" Bosch Group, http://www.boschrexroth.com/country_units/america/canada/en/10_products/technology_areas/brp/RTC/index.jsp, visited Oct. 17, 2013, 1 page.

International Search Report and Written Opinion issued for PCT/US2013/065615 dated Jan. 17, 2014, 10 pgs.

* cited by examiner

RECIPROCATING AND ROTATING SECTION AND METHODS IN A DRILLING SYSTEM

PRIORITY

The present application claims priority to and the benefit of the filing date of U.S. Patent Application No. 61/784,381, titled "Reciprocating and Rotating Section and Methods in a Drilling System", filed Mar. 14, 2013, and of the filing date of U.S. Patent Application No. 61/720,725, titled "Reciprocating and Rotating Section and Methods", filed Oct. 31, 2012, both of which are incorporated herein by reference.

BACKGROUND OF THE DISCLOSURE

Top drive systems are used to rotate a drill string made up of tubulars within a wellbore. Some top drives include a quill that provides vertical float between the top drive and the drill string, where the quill is usually threadedly connected to an upper end of a tubular of the drill string to transmit torque and rotary movement to the drill string. Alternatively, it may be indirectly linked to the drill string through a clamp, for example.

While drilling, drilling fluids or drilling mud are delivered to the drill string through a washpipe system connected to the quill. From the top drive and associated wash pipe, the fluids are transported and supplied to the drill string through the quill. Sometimes additional drilling fluids such as cement, chemicals, epoxy resins, etc. are also delivered downhole via the same system.

Conventional washpipes move axially and rotationally relative to surrounding support structure. A single seal is arranged to seal against the washpipe to prevent leakage of drilling fluid. Since the seal is subject to frictional movement in both the rotational and the axial directions, the seal wears quickly, requiring frequent replacement. Thus, drilling must be halted while the seal is replaced. This frequent downtime increases drilling expenses and slows the overall drilling progress.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
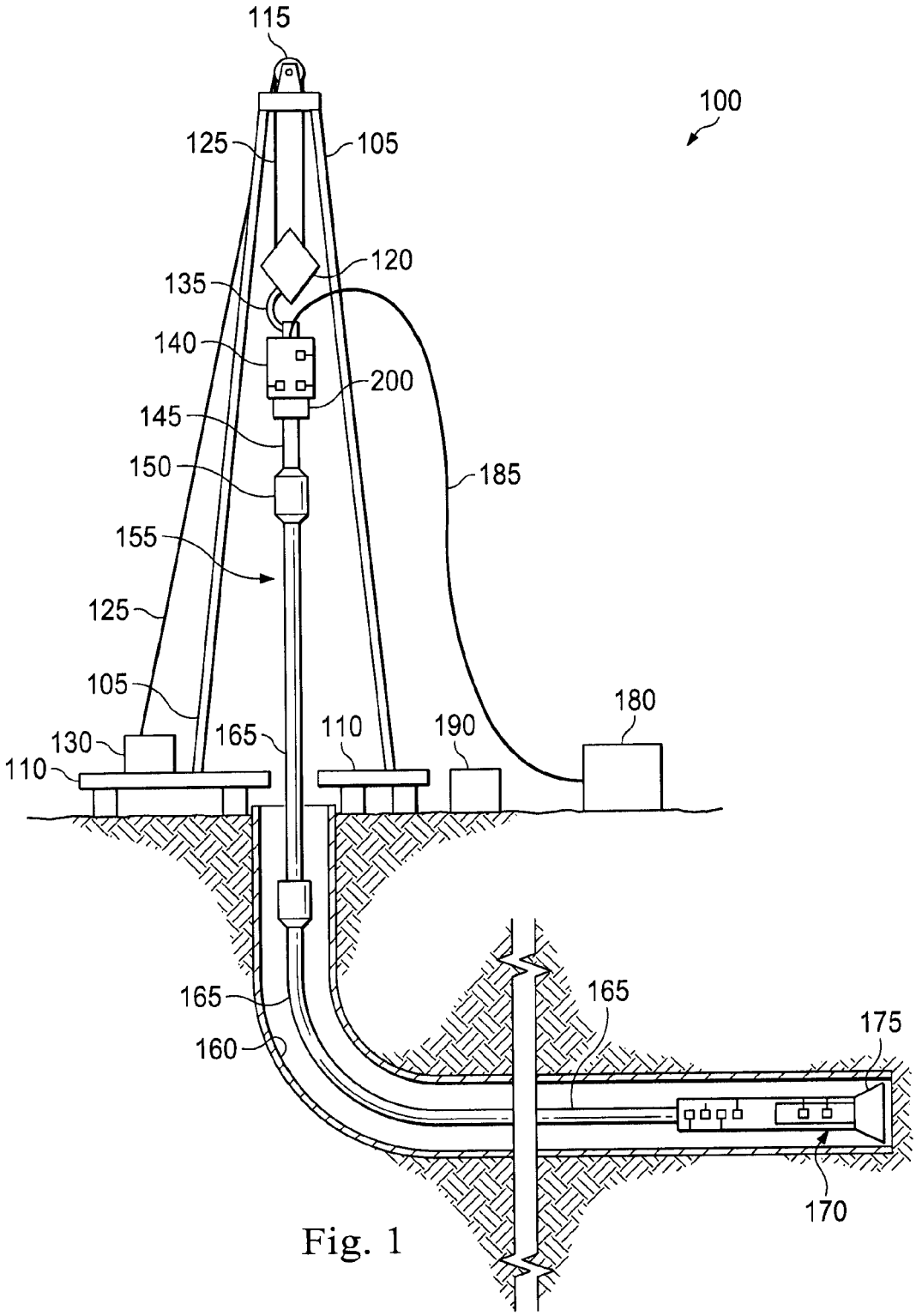
FIG. 1 is a schematic of an apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure is directed to apparatuses and methods having a unique structural arrangement that separates rotational movement in a drilling system from axial or reciprocating movement in the drilling system. This is particularly useful for connecting a washpipe, a quill, and a stationary section of drilling system. In an exemplary aspect, an upper part of the washpipe (referred to below as a conduit) is rotationally coupled to the stationary section of the larger drilling system, such as a top drive of a drilling rig, while a lower part of the washpipe is reciprocatingly coupled to the quill. Because of this, a rotational seal can be used to seal the rotational coupling and a separate reciprocating seal can be used to seal the reciprocating coupling. Since each seal is subject to only one type of interfacing motion, the wear is dramatically reduced, improving the overall usable life of the seal, resulting in more efficient drilling, and less rig down-time for maintenance and repair, ultimately increasing profitability.

Referring to FIG. 1, illustrated is a schematic view of an apparatus 100 demonstrating one or more aspects of the present disclosure. The apparatus 100 is or includes a land-based drilling rig. However, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others within the scope of the present disclosure.

The apparatus 100 includes a mast 105 supporting lifting gear above a rig floor 110. The lifting gear includes a crown block 115 and a traveling block 120. The crown block 115 is coupled at or near the top of the mast 105, and the traveling block 120 hangs from the crown block 115 by a drilling line 125. One end of the drilling line 125 extends from the lifting gear to drawworks 130, which is configured to reel out and reel in the drilling line 125 to cause the traveling block 120 to be lowered and raised relative to the rig floor 110. The other end of the drilling line 125, known as a dead line anchor, is anchored to a fixed position, possibly near the drawworks 130 or elsewhere on the rig.

A hook 135 is attached to the bottom of the traveling block 120. A top drive 140 is suspended from the hook 135. A quill 145 extending from the top drive 140 is attached to a saver sub 150, which is attached to a drill string 155 suspended within a wellbore 160. Alternatively, the quill 145 may be attached to the drill string 155 directly. It should be understood that other conventional techniques for arranging a rig do not require a drilling line, and these are included in the scope of this disclosure.

The drill string 155 includes interconnected sections of drill pipe 165, a bottom hole assembly (BHA) 170, and a drill bit 175. The bottom hole assembly 170 may include stabilizers, drill collars, and/or measurement-while-drilling (MWD) or wireline conveyed instruments, among other components. The drill bit 175, which may also be referred to herein as a tool, is connected to the bottom of the BHA 170 or is otherwise attached to the drill string 155. One or more pumps 180 may deliver drilling fluid to the drill string 155 through a hose or other conduit 185, which may be fluidically and/or actually connected to the top drive 140. This embodiment includes a system 200 that may be referred to as a telescoping washpipe system disposed between the top drive 140 and the quill 145. The system 200 is described more fully further below.

Still referring to FIG. 1, the top drive 140 is used to impart rotary motion to the drill string 155. However, aspects of the present disclosure are also applicable or readily adaptable to implementations utilizing other drive systems, such as a power swivel, a rotary table, a coiled tubing unit, a downhole motor, and/or a conventional rotary rig, among others.

The apparatus 100 also includes a control system 190 configured to control or assist in the control of one or more components of the apparatus 100. For example, the control system 190 may be configured to transmit operational control signals to the drawworks 130, the top drive 140, the BHA 170 and/or the pump 180. The control system 190 may be a stand-alone component installed near the mast 105 and/or other components of the apparatus 100. In some embodiments, the control system 190 is physically displaced at a location separate and apart from the drilling rig.

Figure 2:
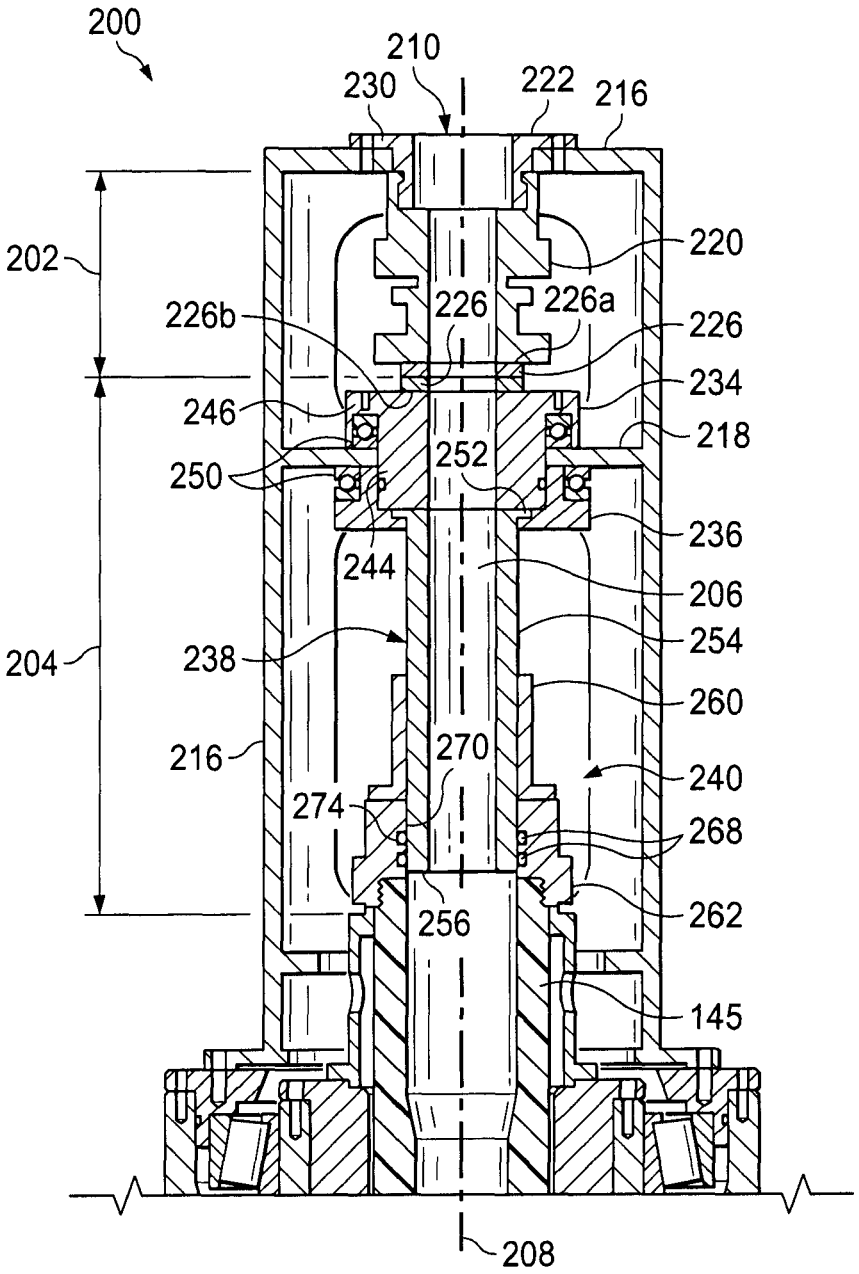
FIG. 2 is a sectional view of an apparatus in a first mode of operation according to one or more aspects of the present disclosure.
Figure 3:
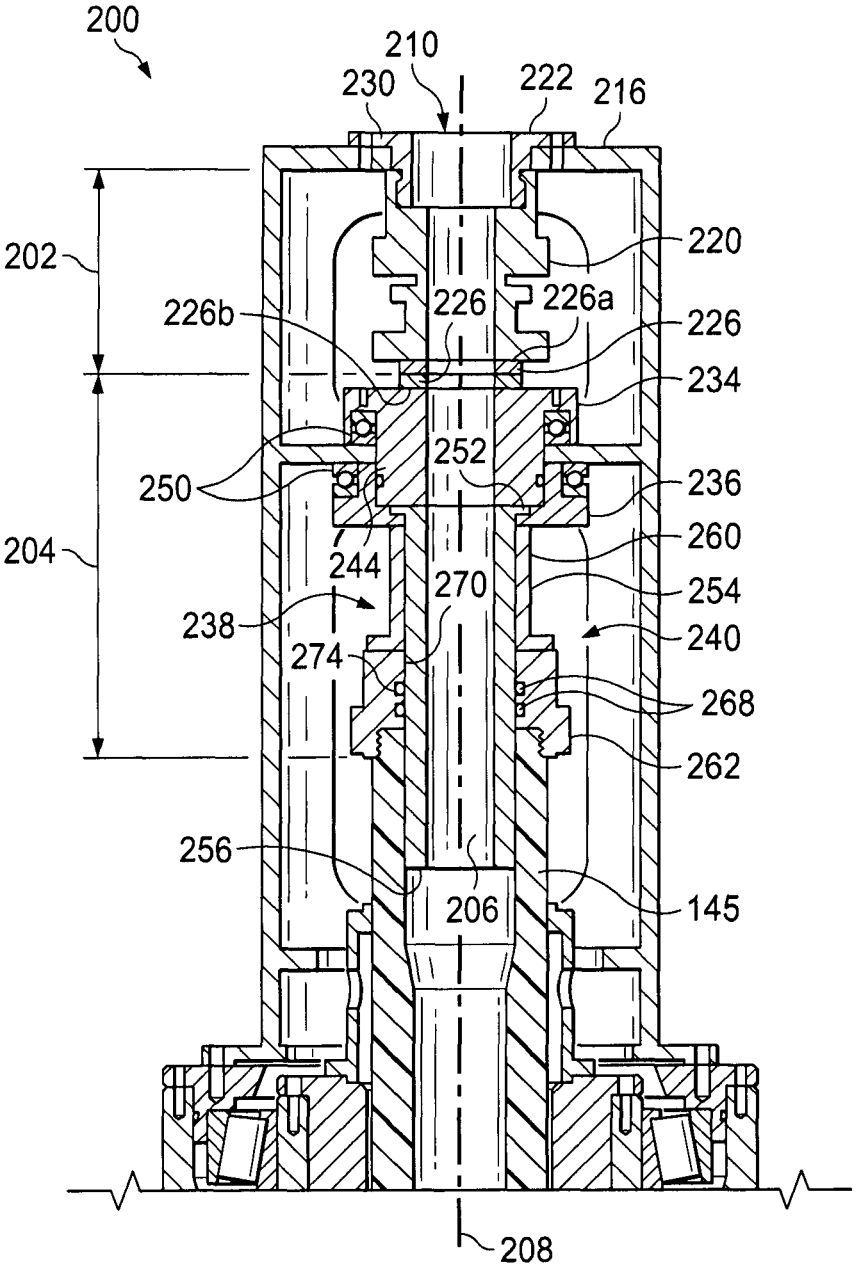
FIG. 3 is a view similar to that of FIG. 2, but depicts the apparatus of FIG. 2 in another operational mode, according to one or more aspects of the present disclosure.
Figure 4:
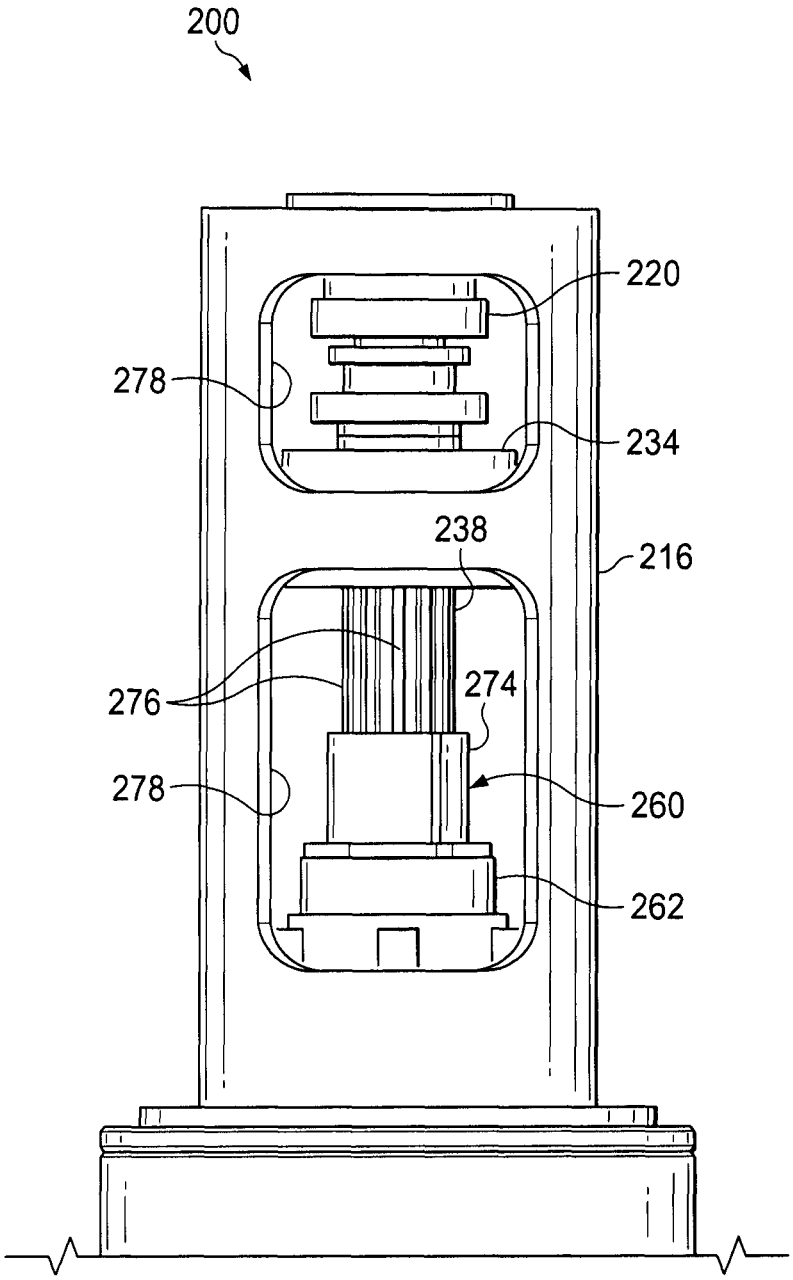
FIG. 4 is a front elevational view of the apparatus of FIGS. 1 and 2, according to one or more aspects of the present disclosure.

FIGS. 2-4 show an exemplary embodiment of the system 200 referenced in FIG. 1 that may reduce or prevent seal wear, resulting in more efficient well-drilling. The system 200 connects to or is driven by the top drive (FIG. 1). For explanatory purposes, the system 200 is divided into sections. Accordingly, as referenced in FIG. 2, the system 200 includes a first stationary section 202 and a second rotating and reciprocating section 204. The stationary section 202 connects with a non-rotating portion of the top drive 140, for example, and the rotating and reciprocating section 204 connects to a tubular of the drill string 155 (FIG. 1) to make a part of a well casing.

FIG. 2 shows the system 200 with a portion of the rotating and reciprocating section 204 in a down position, and FIG. 3 shows the system 200 with a portion of the rotating and reciprocating section 204 in the up position. Accordingly, as can be seen by comparison of these Figures, the length of the rotating and reciprocating section 204 changes depending on the position of the elements of the rotating and reciprocating section 204.

The following description references FIGS. 2 and 3. A fluid flow passage 206 having a longitudinal axis 208 extends through both the stationary section 202 and the rotating and reciprocating section 204. An inlet 210 to the flow passage 206 is formed at the stationary section 202, and provides fluid to the quill 145 connected to the rotating and reciprocating section 204. A bonnet or housing 216 is disposed over both the stationary section 202 and the rotating and reciprocating section 204. In this embodiment, the housing 216 is rigidly connected to the stationary section 202 and includes an intermediate support section 218 extending radially inwardly. In the exemplary embodiment shown, the intermediate support section 218 supports at least a portion of the stationary section 202 and the rotating and reciprocating section 204 as discussed below.

Referring to FIG. 2, the stationary section 202 includes an upper connection 220, a housing fixture 222 connecting the upper connection 220 the housing 216, and a first portion 226*a* of a rotational seal 226. The upper connection 220 is a rigid element forming a portion of the fluid flow passage 206. The housing fixture 222 also forms a portion of the fluid flow passage 206 and includes a flange 230 securing the housing 216 in place. The housing fixture 222 operably connects to a portion of the top drive 140 so that drilling fluid may pass from the hose 185 (FIG. 1) through the top drive 140 and through the inlet 210 during operation of the top drive motor.

The rotating and reciprocating section 204 includes a second portion 226*b* of the rotational seal 226, a first rotating component 234, an upper connection 236, a washpipe referred to herein as a conduit 238, and a reciprocating assembly 240.

The second portion 226*b* of the rotational seal 226 abuts the first portion 226*a* of the rotational seal 226, coupling the stationary section 202 and the rotating and reciprocating section 204 in a sealed and rotatable matter. Accordingly, the first and second portions 226*a*, 226*b* of the rotational seal 226 accommodate rotation while preventing fluid ingress and egress between the fluid flow passage 206 and the outer environment. As such, the sections 202, 204 rotate about the longitudinal axis 208.

The first rotating component 234 is fixedly connected to, and may carry the second portion 226*b* of the rotational seal 226. It includes a boss portion 244 and an extending flange portion 246 that extends over the intermediate support section 218 of the housing 216, preventing the first rotating component 234 from passing through the housing 216. The boss portion 244, however, extends through a central opening in the intermediate support section 218. This also results in the flanged portion 246 of the rotating component 234 being captured in the housing 216 with the stationary section 202.

The upper connection 236 is rigidly affixed to the first rotating component 234. In the endowment shown, it receives the boss portion 244 of the upper connection 236. It may be connected to the upper connection 236 using any known method, but in some embodiments, is welded. In other embodiments, the first rotation component 234 is threaded onto the upper connection 236 or it may be bolted, riveted, or otherwise adhered. The upper connection 236 is intended to rotate with the first rotating component 234 and therefore, the connection may include rotation engaging mechanical interference members, such as splines or other features that rotationally secure the upper connection 236 and the first rotating component 234 together. In this embodiment, the upper connection 236 is disposed below the intermediate support section 218 of the housing 216. In some embodiments, a gasket, such as an O-ring (not shown), may be disposed between the upper connection 236 and the lower rotating component 234 to inhibit or prevent the leakage of drilling fluid out of the conduit 238. Certain gaskets, such as an O-ring, may also permit wobbling (also referred to as runout) of the quill during rotational operation without causing increased wear on the equipment.

To accommodate the rotating first rotating component 234 and the upper connection 236 in the stationary housing 216, the system 200 includes a plurality of bearing sets 250. The bearing sets 250 are disposed between the intermediate support section 218 of the housing 216 and flanges on the first rotating component 234 and on the upper connection 236 to facilitate the rotational capacity of these components. It's worth noting that the intermediate support section 218 of the housing 216, along with an upper portion of the housing 216, assures proper tolerances for the stationary section 202 and the rotational seal 226. This may enable easy replacement of the rotational seal 226 when the rotational seal 226 becomes worn due to frictional and exertional forces acting on it when the top drive is in operation. In addition, components of the rotating portion 204 may be easily replaced if any portion becomes broken or needs repair to form a more efficient seal.

The upper connection 236 is fixedly engaged with the washpipe or conduit 238. Accordingly, the conduit 238 rotates with the upper connection 236. The conduit 238 is configured to provide fluid passage from the stationary section to the bore of the quill 145 of the system 200. In this example, the conduit 238 includes an upper flange 252 wider than an opening in the upper connection 236, while a body 254 of the conduit extends through the opening toward the quill 145. A lower end 256 of the conduit 238 has a diameter matching that of the body 254 of the conduit. As explained below, this may enable reciprocating seals to be placed about the conduit 238. The length of the conduit 238 is selected to provide a telescoping capability as will be described further below.

The reciprocating assembly 240 is configured and arranged to reciprocatingly or axially slide along the conduit 238, as can be seen by a comparison of FIG. 2 and FIG. 3. In this embodiment, the reciprocating assembly 240 includes an anti-rotation mechanism 260 and a lower connection 262. The anti-rotation mechanism 260 and the lower connection 262 are sized and otherwise configured to slidably connect to the conduit 238. These are configured to reciprocate on the conduit 238, such that they slide over the outer surface of the conduit 238 in the axial or longitudinal direction.

The anti-rotation mechanism 260 is an optional mechanism operably connected to the conduit 238 and the upper end of the lower connection 262. The anti-rotation mechanism 260 in this embodiment connects various components together to ensure they rotate in unison to minimize or avoid additional wear on surfaces that are moving past each other. Thus, the anti-rotation mechanism 260 may connect to the conduit 238, and the lower connection 262. In one embodiment, the anti-rotation mechanism 260 additionally is configured to prevent rotational differences between these above-noted components and the quill 145. Although the anti-rotation mechanism 260 is capable of rotating at the same rate as or simultaneously with the conduit 238, quill 145, and lower connection 262, in one embodiment, the anti-rotation mechanism 260 is also capable of minimizing, or slowing down the rate of or preventing rotation of these components in the event they become out of unison. Additionally, the anti-rotation mechanism 260 is capable of reciprocating movement, along with the quill 145 and the lower connection 262, along the axis 208 of the tubular string or quill along with or along the conduit 238.

As indicated above, the anti-rotation mechanism 260 inhibits or prevents relative rotation between itself and conduit. As will be discussed below, it also reciprocates along the conduit 238. It may therefore be mechanically connected by features, such as splines that extend longitudinally. FIG. 4 shows a side elevational view of the system 200. In this embodiment, the anti-rotation mechanism 260 includes a tubular body 274 through which the conduit 238 extends and in which circumferentially-spaced internal splines (not shown) are formed, which internal splines engage respective external splines 276 extending longitudinally along the conduit 238.

In some embodiments, the conduit 238 has a cylindrical shape whose cross-section is circular, rounded, elliptical, oval, polygon, or non-circular in shape. In embodiments where a sufficiently non-circular cross-section of conduit is used, the apparatus may not include a separate anti-rotation mechanism 260 because the conduit 238 with, e.g., the elliptical or oval cross-section, is able to at least substantially, and in one embodiment entirely prevent, rotation of the quill 145, conduit 238, and lower connection 262 relative to each other. Instead the quill or lower connection 262 may form the anti-rotation mechanism.

The lower connection 262 includes a through passage having an inner surface 270 having a seal seat 274 formed therein. The inner surface 270 is shaped and configured to substantially match the shape of the outer surface of the conduit 238. The conduit 238 extends through the passage through the lower connection 262. The seal seat 274 is configured to maintain the sealing members 268 within the lower connection 262 and in contact with the conduit 238, and reduce or prevent the leakage of drilling fluid out of the fluid flow passage 206. The anti-rotation mechanism 260 extends the life of the reciprocating seal members 268 by reducing or eliminating the relative rotation and rotational friction between the conduit 238 and the seal member 268. Accordingly, the reciprocating seal members 268 are subject to primarily only movement in the axial or reciprocating direction.

The sealing members 268 may be made of any material available to one of ordinary skill in the art, including without limitation one or more natural or synthetic elastomers or other polymeric materials. Exemplary standard sealing members 268 include, without limitation, standard commercially available wiper/scraper-style seals (e.g., POLYPAK seal or CHEVRON shaped seal), as well as any other lip seal (e.g., single, dual, triple, etc.) capable of withstanding the pressure and chemical compositions of various drilling fluids. Such sealing members 268 may be self-energizing or non-self-energizing. In some embodiments, the sealing members 268 inhibit or prevent leakage of drilling fluid. In several exemplary embodiments, the sealing members 268 may be in the form of piston seals. Other types of sealing members are also contemplated.

In addition the lower connection 262 of the reciprocating assembly is configured to sealably attach to the quill 145. In the embodiment shown in FIG. 2, the lower connection 262 and the quill 145 attached via threads, however other attachment mechanisms are contemplated. In between the lower connection 262 and the quill 145 at least one or more additional gaskets, such as an O-ring, may be placed for one of a variety of reasons, such as to inhibit or prevent ingress or egress of drilling fluid between the two components. As the use of threads alone may not typically create a sufficient seal, the at least one or more additional gaskets may be provided for this purpose. Unlike the upper connection 236, the lower connection 262 is capable of reciprocating movement along a portion of the length of the conduit 238. In various embodiments, the lower connection 262 moves along the axis of the tubular string or quill at substantially the same time as the quill 145 and these two components are operably or directly connected.

The quill 145 (or equipment operably connected thereto) is configured to clamp, thread, couple, connect, or otherwise grab, collectively referred to herein as "engage," a tubular of the drill string 155 (FIG. 1) to be added to or removed from the tubular string. As a part of this, the quill 145 is configured to reciprocate relative to the conduit 238. When in use, the quill 145 is rigidly connected with the lower connection 262 so that the quill rotates with the lower connection 262 and with the complete rotating and reciprocating section 204. In this embodiment, the quill 145 includes an inner fluid flow passage and is configured to receive the lower end of the conduit 238. Accordingly, the diameter of the inner fluid flow passage is greater than the outer diameter of the conduit 238. The quill is configured to rotate about an axis of rotation co-axial with an axis of orientation of the quill, the tubular, and the conduit 238. Accordingly, fluid may flow even while the quill 145 rises and falls during rotational use.

The quill 145 is capable of both rotational and reciprocating movement to facilitate operations, such as drilling, casing, or the like. The quill is operably coupled to the lower connection 262, and potentially other components of the top drive as well as either being engaged or disengaged at its lower end directly with or from a tubular, or through additional rig structure. When engaged with a tubular, the quill 145 is typically in the first operational configuration as depicted in FIG. 2. The weight of the tubular pulls the quill 145 relatively downward, or away from the stationary section 202. When disengaged from a tubular, the quill 145 may be positioned in the second operational configuration, as depicted in FIG. 3, relatively upwards or towards the stationary section 202.

In one aspect of the disclosure, the quill 145 may reciprocate anywhere from about 0.5 inches to about 3 feet, preferably from about 4 inches to about 2.5 feet, and more preferably from about 8 inches to about 2 feet. The reciprocating motion or "float" of the quill will minimize pipe or quill thread wear and is more efficient than the method of "counter-balancing" the entire top drive weight (as done in other applications). Not counterbalancing the weight of the top drive or having incorrect setting of the counterbalancing mechanism can have devastating effects on the lifetime of the threads or the quality of the connection between the quill and the drill pipe or other pipe assemblies, such as crossover subs or valves, when compared to the use of a floating quill 145. Another problem is reflected in the present rotating seals of the wash-pipe. For example, at typical top drive operational pressure and rotational speeds exceeding 5,000 PSI and/or 120 RPM, the lifetime of the seals are drastically reduced to about 20 to about 100 hours of life. In comparison, the present disclosure may increase the lifetime of the seals or sealing surfaces present to at least about 500 to 2,500 hours, because the "mechanical" rotational seals are specifically designed for these parameters, and the reciprocating seals (needed to maintain the floating quill technology), are relatively stationary in the rotational direction with respect to the seal surface (e.g., both the seal and sealing surface are stationary or are rotating at approx. the same speed). As used herein, relatively stationary includes rotations of less than an entire revolution. It is worth noting that in some aspects, the anti-rotation mechanism prevents rotation or more than a full revolution between the conduit and the reciprocating portion. In other aspects, the anti-rotation mechanism permits relative rotation between the conduit and reciprocating portion at speeds lower than the relative rotation between the stationary section and the rotating and reciprocating section. In another aspect, the seals or sealing surfaces may have a lifetime of at least about 1,000 hours to 5,000 hours, or more. In yet another aspect, the seals or sealing surfaces may have a lifetime of about 1,000 to about 1,500 hours of lifespan. This may be achieved by the interaction of three types of surfaces, namely a) the stationary, non-reciprocating portion; b) the rotating portion which rotates about an axis that is typically axially oriented along the tubular and/or drive shaft; and c) the reciprocating portion that moves up and down, i.e., vertically, relative to the tubular and/or drive shaft.

This may be achieved according to the present disclosure, for example, by positioning the rotational seal 226 adjacent to rotating and reciprocating section 204 via the arrangement that eliminates the reciprocating motion of the lower rotating component 234 to operably connect the rotating and stationary (non-reciprocating) surfaces of the rotational seal 226. Thus, the rotational seal 226, and the seals and sealing surfaces associated therewith, may only rotate although the rotating and reciprocating section 204 both reciprocates and rotates in operation. By minimizing or eliminating the reciprocating movement of radial seals according to the discussion herein, substantially lower seal wear may advantageously occur and therefore less frequent maintenance (and consequently, additional available operating time) may be achieved with this aspect of the disclosure.

In addition, the use of gravitational force to pull the quill 145 and connected tubular when using the quill 145 reduces the amount of pressure exerted on the threads of the tubulars, when compared to systems that use counterbalance cylinders. In one embodiment, the use of gravitational forces also eliminates the need for control circuits that would control the reciprocating movement of the quill 145. It should be understood that such control circuits and systems such as counterbalance cylinders may still be used in connection with the present disclosure.

FIG. 3 shows one embodiment of the present disclosure in which the quill 145 and rotating and reciprocating section 204 are in the second position, wherein the quill 145 and rotating and reciprocating section 204 are contracted, e.g., while the quill 145 is disengaged from a tubular therebelow (not shown in FIG. 3). The rotational seal 226 remains in substantially the same axial location and does not move up or down with respect to the conduit 238. While the upper connection 236 remains stationary in the axial direction and does not substantially move in a vertical or downward direction as the quill 145 reciprocates, the lower connection 262 is able to move in a relatively vertical or downward direction as the quill 145 reciprocates while remaining operably connected to the quill 145 itself. Anti-rotation mechanism 260 keeps conduit 238, lower rotating component 234, and upper connection 236 together, such that the conduit 238 rotates with or at least substantially with quill 145. Sealing members 268 (which for clarity may be one or more sealing members) may not provide enough friction for the tubular to rotate with the quill, particularly if the tubular is slippery. Thus, the anti-rotation mechanism 260 may ensure different parts of the apparatus disclosed herein rotate together or substantially together, for example, to keep the conduit 238 rotating with quill 145; anti-rotational mechanism 260 turning the conduit 238, upper connection 236 locked to conduit 238 which is in turn locked to lower rotating component 234. The quill 145 and the lower connection 262 are locked together and rotate together instead of out-of-phase. In one aspect of the disclosure, the anti-rotation mechanism 260 and the lower connection 262 are integrally-formed and this component performs the functions of both the anti-rotation mechanism and the lower connection. When fully contracted, the anti-rotation mechanism 260 slides along the conduit 238 and may touch the lower rotating component 234 of the mechanical seal, although typically it may be designed to avoid contact as this may cause additional wear when rotating occurs. When the quill 145 is in the second configuration, the internal components thereof are contracted, while the external components thereof surround the conduit 238. The external components of the quill 145 move or glide up along the conduit 238 and may act to push the lower connection 262 and the anti-rotation mechanism 260 up towards the upper connection 236. The housing 216 remains in the same location and does not substantially move when the quill 145, conduit 238, or seals are in operation.

FIG. 4 shows one embodiment of the present disclosure in which the housing 216 is shown surrounding the internal components including the quill 145, the rotating and reciprocating section 204, the rotational seal 226, the conduit 238 and at least a portion of the fluid inlet 210. The housing 216 typically contain gaps or windows 278 to facilitate any desired fluid and/or electrical connections, for viewing of the workings of the internal components, and to facilitate exchange of the components internal to the housing 216 when desired.

Figure 5:
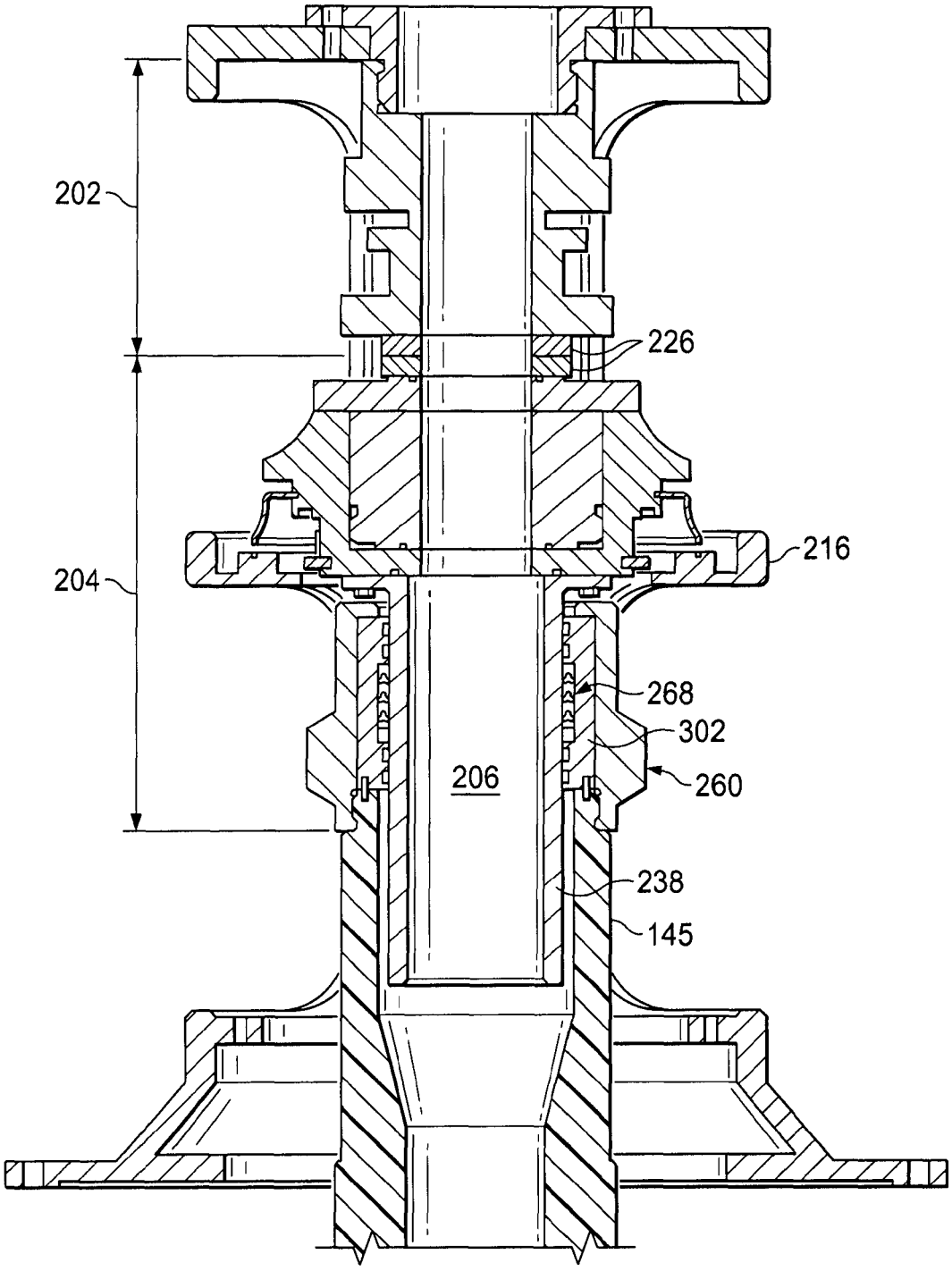
FIG. 5 is a sectional view of an apparatus according to one or more aspects of the present disclosure.

FIG. 5 shows one embodiment of the present disclosure in which the quill 145 and rotating and reciprocating section 204 are in the second position (as also shown in FIG. 3). Sealing members 268 are adapted to rotate and reciprocate, typically along with the conduit 238, and are at least partially surrounded by a seal carrier 302 that is adapted to rotate and reciprocate along with the quill 145. An anti-rotation mechanism 260 may be present and at least partially surround the seal carrier 302 to inhibit or prevent rotation between various components of the structure during operation, i.e., so in one embodiment such components may rotate without slippage between them. This may advantageously increase reciprocating seal life.

Figure 6:
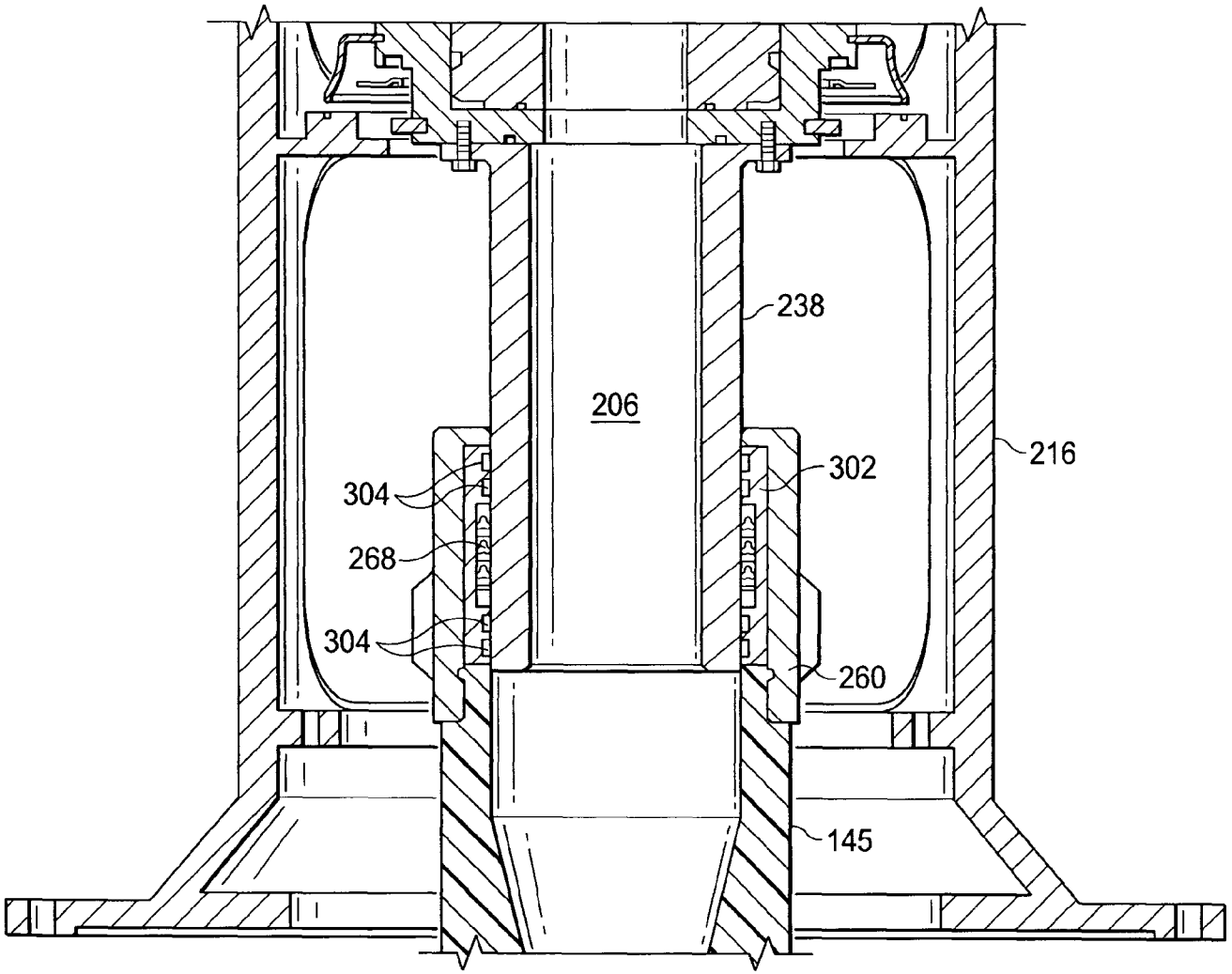
FIG. 6 is a sectional view of an apparatus according to one or more aspects of the present disclosure.

FIG. 6 shows one embodiment of the sealing members 268 in conjunction with the seal carrier 302 and the conduit 238. The conduit 238 may be oval, non-circular, polygon-shaped or otherwise irregularly rounded but with a sufficiently eccentric (i.e., non-circular) shape to inhibit or prevent the seal carrier 302 from rotating relative thereto. The seal carrier 302 typically completely surrounds or encases the outer circumference of the conduit 238, and/or the sealing members 268. The anti-rotation mechanism 260 substantially surrounds the seal carrier 302 in this embodiment but the seal carrier 302 may function as the anti-rotational mechanism 260. Bearings 304 may be placed above and below the sealing members 268 and contact the conduit 238. At least a portion of the sealing members 268, seal carrier 302 and anti-rotation mechanism 260 are in contact with the conduit 238. Further, the quill 145 contacts the anti-rotation mechanism 260, the seal carrier 302, and the conduit 238 when it is in a first configuration.

Figure 7:
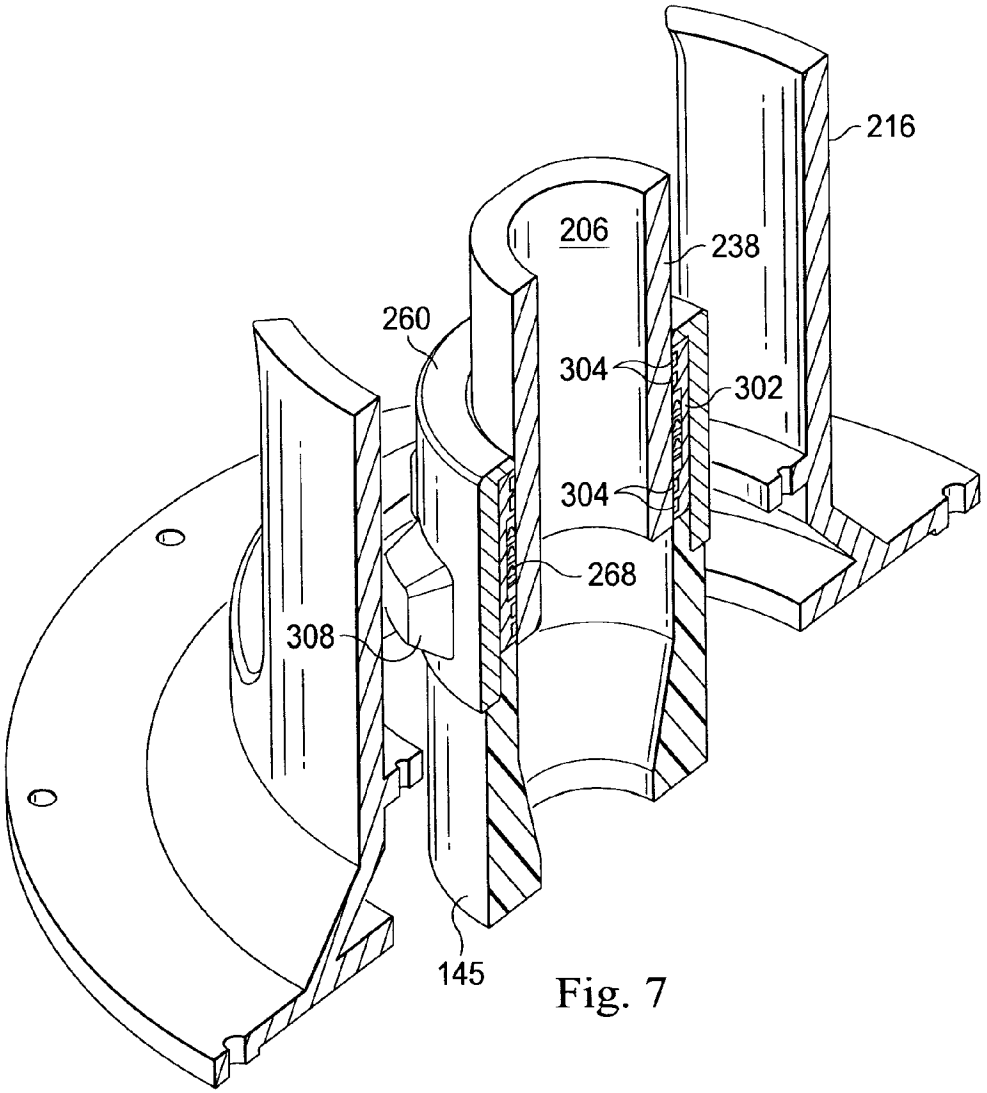
FIG. 7 is a sectional view of an apparatus according to one or more aspects of the present disclosure.

FIG. 7 shows one embodiment of the seal carrier 302 juxtaposed against the conduit 238. The seal carrier 302 is enclosed by the anti-rotation mechanism 260 in this embodiment. The conduit 238 may be directly contacted by the sealing members 268 and the seal carrier 302, as well as the bearings 304. Bearings 304 enable the reciprocation of the sealing members 268 and/or the rotation of the conduit 238 in this embodiment, while the seal carrier 302 reciprocates and rotates with the conduit 238 or remains stationary. As can be seen in FIG. 7, in this example, the conduit 238 also includes a non-circular cross-section. Here it appears oval-shaped. Because of this, in some aspects, the anti-rotation mechanism 260 has a mating shape that permits the anti-rotation mechanism to slide axially or reciprocatingly, while relative rotation is limited or prevented by mechanical interference. Here, lugs 308 on the anti-rotation mechanism 260 also may optionally be used to provide mechanical interference to prevent rotation.

Figure 8:
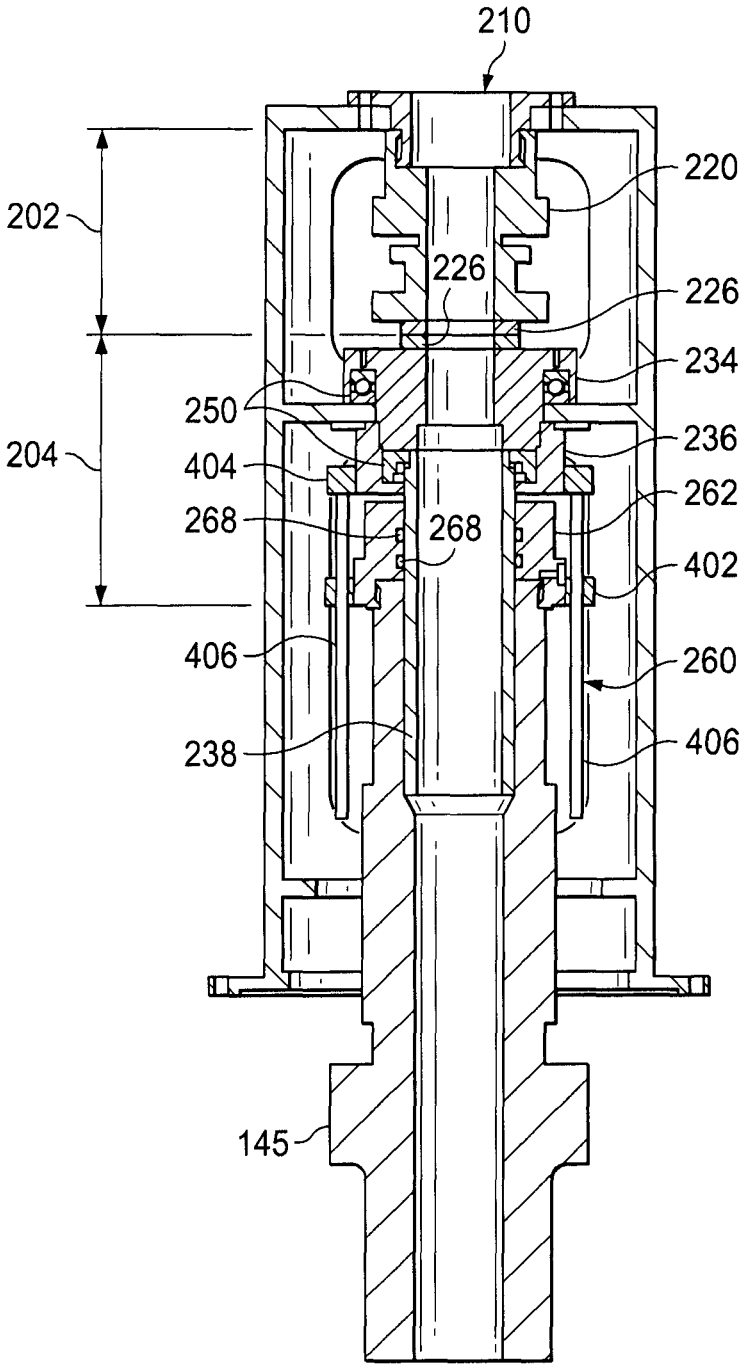
FIG. 8 is a sectional view of an apparatus according to one or more aspects of the present disclosure.
Figure 9:
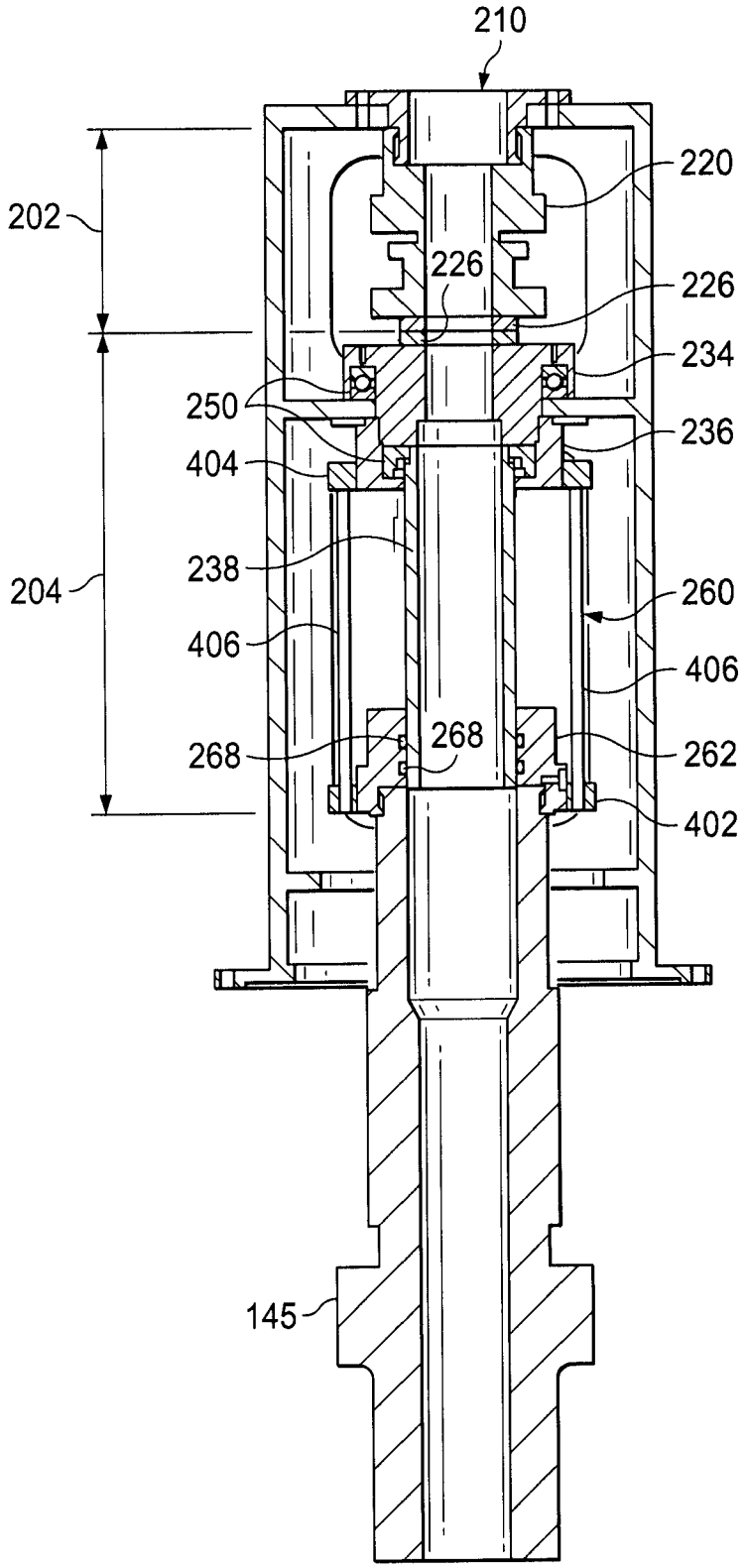
FIG. 9 is a view similar to that of FIG. 8, but depicting the apparatus of FIG. 8 in another operational mode, according to one or more aspects of the present disclosure.

Referring to FIGS. 8 and 9, illustrated are section views of an apparatus according to yet another embodiment. The apparatus of FIGS. 8 and 9 includes components that are identical to the components of the apparatus of FIGS. 2, 3 and 4, which identical components are given the same reference numerals. In the apparatus of FIGS. 8 and 9, the tubular body 260 and the internal splines formed therein, as well as the external splines 276, are omitted from the anti-rotation mechanism 260. Instead, the anti-rotation mechanism 260 of the apparatus of FIGS. 8 and 9 includes a collar 402 through which circumferentially-spaced bores (not shown) are formed. The collar 402 is coupled to the lower connection 262 and thus to the quill 145. A collar 404 is coupled to the upper connection 262 and thus to the conduit 238. A plurality of rods 406 are coupled to the collar 404 and extend downward therefrom. The rods 406 extend through the circumferentially-spaced bores, respectively, formed through the collar 402.

The operation of the apparatus of FIGS. 8 and 9 is identical to the operation of the apparatus of FIGS. 2-4, except with respect to the operation of the anti-rotation mechanism 260. In operation, in an exemplary embodiment, the anti-rotation mechanism 260 of FIGS. 8 and 9 prevents relative rotation between the conduit 238 and the quill 145. More particularly, the coupling of the rods 406 to the upper connection 262 and thus to the conduit 238, and the extension of the rods 406 through the collar 404 (which is coupled to the quill 145), prevent relative rotation between the conduit 238 and the quill 145. As a result, the conduit 238 and the quill 145 rotate in unison or almost in unison, thereby facilitating the sealing engagement of the seals 268 against the outside surface of the conduit 238.

While preventing relative rotation between the conduit 238 and the quill 145, the anti-rotation mechanism 260 permits relative axial movement between the conduit 238 and the quill 145. More particularly, as shown in FIG. 8, the quill 145 is permitted to move or "float" upward so that the conduit 238 is further received by, or further telescopes into, the quill 145. As shown in FIG. 9, the quill 145 is permitted to move or "float" downward so that a portion of the conduit 238 telescopes out of the quill 145. During this upward and downward movement of the quill 145, the collar 402 moves with the quill 145, sliding along the rods 406. During the upward and downward movement of the lower collar 402, the rods 406 remain axially stationary, although the rods 406 rotate with at least the lower collar 402, the upper collar 404, the lower connection 262, the upper connection 236, the conduit 238, and the quill 145.

Figure 10:
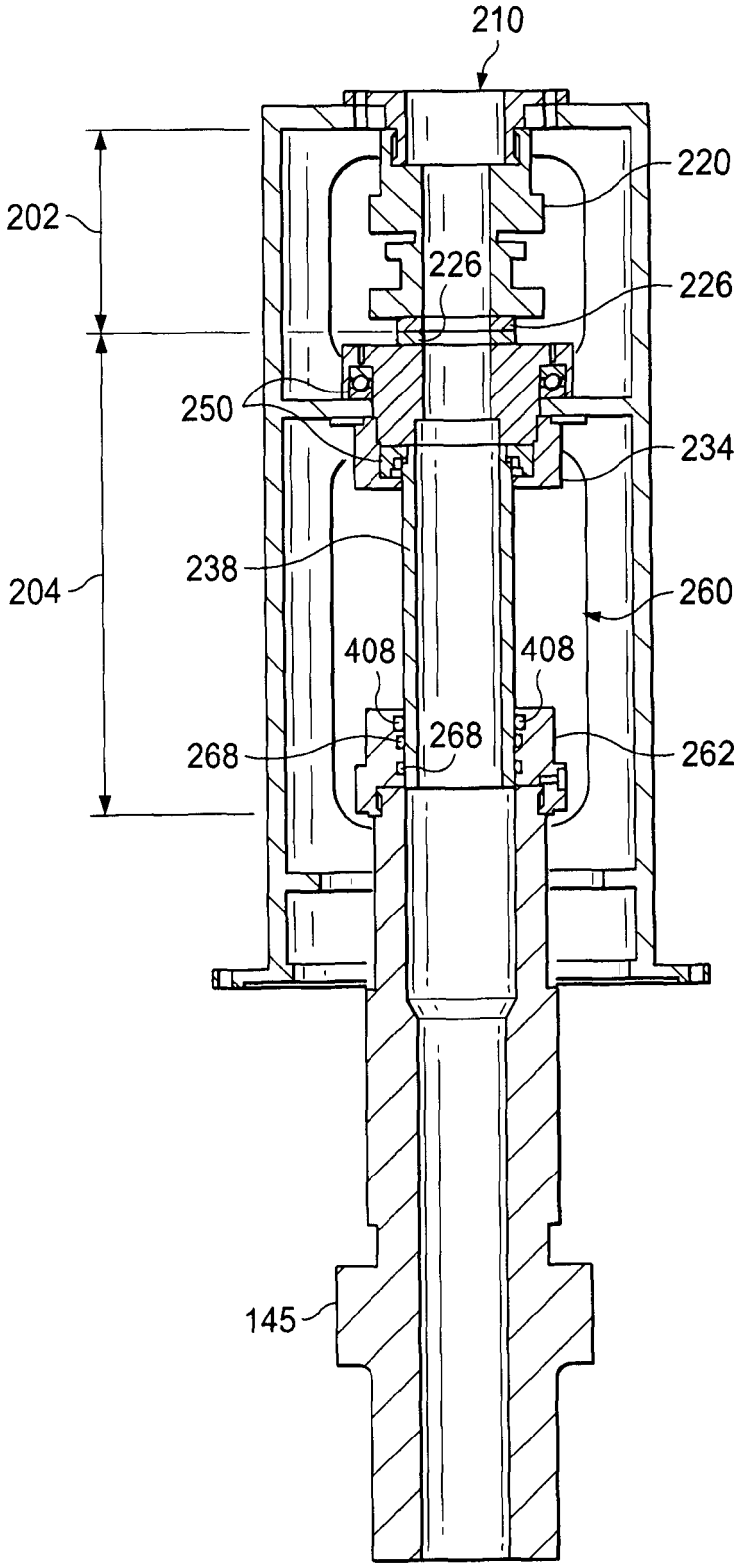
FIG. 10 is a sectional view of an apparatus according to one or more aspects of the present disclosure.

Referring to FIG. 10, illustrated is a section view of an apparatus according to still yet another embodiment. The apparatus of FIG. 10 includes components that are identical to the components of the apparatus of FIGS. 2, 3, and 4, which identical components are given the same reference numerals. In the apparatus of FIG. 10, the tubular body 260 and the internal splines formed therein, as well as the external splines 276, are omitted from the anti-rotation mechanism 260. Instead, the anti-rotation mechanism 260 of the apparatus of FIG. 10 includes a relatively large annular sealing element, such as an O-ring 408, disposed between the outside surface of the conduit 238 and an inside surface of the lower connection 262. The O-ring 408 extends circumferentially around the conduit 238, and is axially disposed between the seals 268 and the upper end of the lower connection 262. In an exemplary embodiment, an annular groove is formed in the outside surface of the conduit 238, and the O-ring 408 extends within the annular groove. In an exemplary embodiment, an annular groove is formed in the inside surface of the lower connection 262, and the O-ring 408 extends within the annular groove. In an exemplary embodiment, respective annular grooves are formed in the outside surface of the conduit 238 and the inside surface of the lower connection 262, and the O-ring 408 extends within the respective annular grooves.

The operation of the apparatus of FIG. 10 is identical to the operation of the apparatus of FIGS. 2-4, except with respect to the operation of the anti-rotation mechanism 260. In operation, in an exemplary embodiment, the anti-rotation mechanism 260 of FIG. 10 prevents relative rotation between the conduit 238 and the quill 145. More particularly, the friction forces provided by the O-ring 408 prevent relative rotation between the conduit 238 and the quill 145. As a result, the conduit 238 and the quill 145 rotate in unison or almost in unison, thereby facilitating the sealing engagement of the seals 268 against the outside surface of the conduit 238. While preventing relative rotation between the conduit 238 and the quill 145, the anti-rotation mechanism 260 permits relative axial movement between the conduit 238 and the quill 145. More particularly, the quill 145 is permitted to move or "float" upward and downward, relative to the conduit 238. During this upward and downward movement of the quill 145, the anti-rotation mechanism 260, including the O-ring 408, moves up and down with the lower connection 262 and the quill 145.

Figure 11:
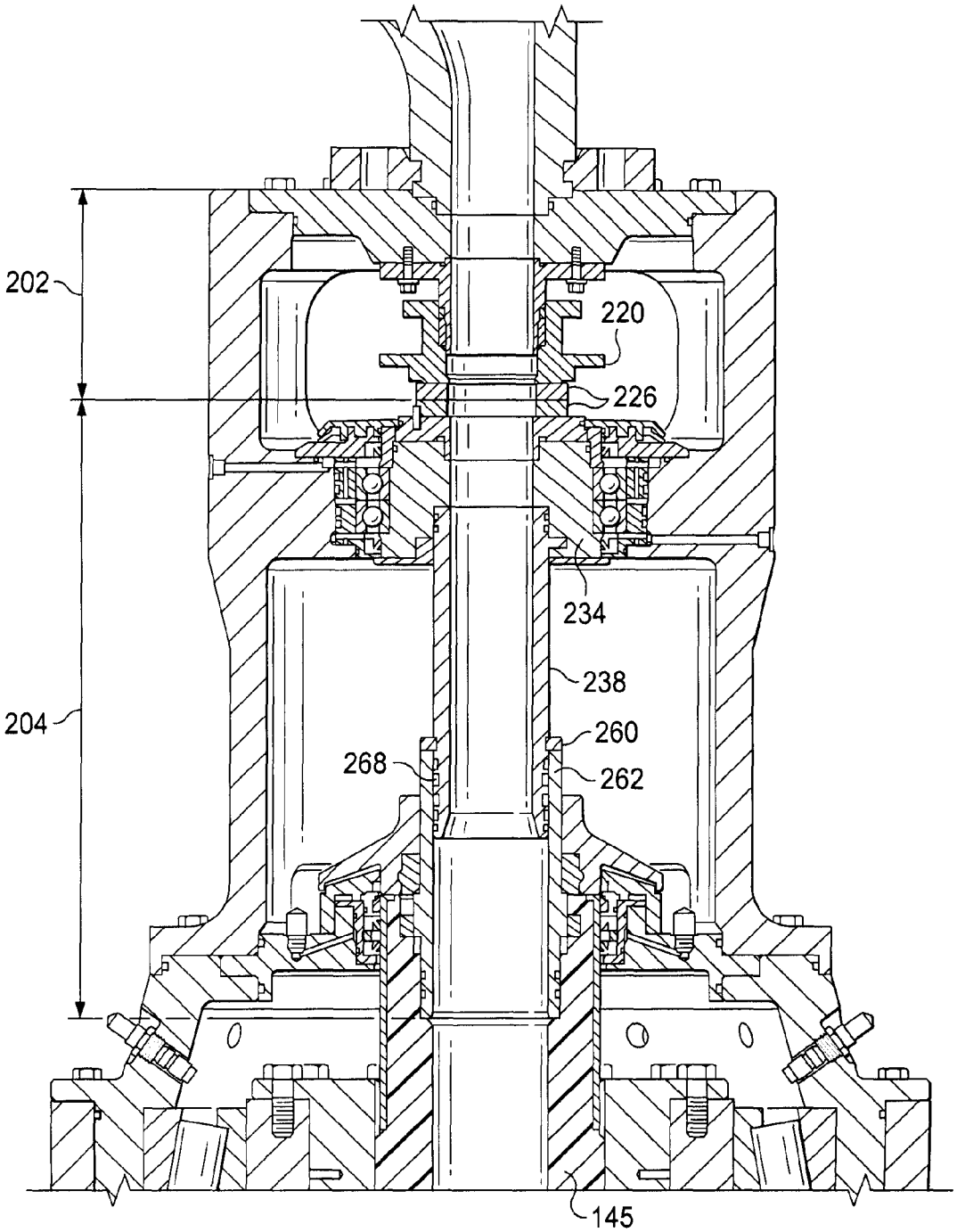
FIG. 11 is a sectional view of an apparatus according to one or more aspects of the present disclosure.

FIG. 11 illustrates a section view of an apparatus according to yet another embodiment. The apparatus of FIG. 11 includes components that are similar in structure or function to the components of the apparatus of FIG. 5, and these components are given the same reference numerals. In the embodiment of FIG. 11 however, the conduit 238 comprises a seal seat containing sealing members 268. Accordingly, the apparatus differs from that in FIG. 5 because the sealing members 268 are axially fixed in place relative to the conduit 238 and slide in the axial direction relative to the quill 145, the lower connection 262, and the anti-rotation mechanism 260. In the embodiment shown, the sealing member 268 seals against and slides along an interior surface of the lower connection 262. However, in yet other embodiments, the sealing members 262 seal against and slide along the quill 145 or the anti-rotation mechanism. Other sliding arrangements are also contemplated.

The methods according to the disclosure may be used to drill a wellbore by, for example, rotating a tubular or a tubular string that is operably coupled to the top drive, or components thereof such as the quill, and the seal assembly of the disclosure. The methods according to the disclosure may also be used to engage or disengage a tubular or tubular string with the top drive, or components thereof such as the quill, and the seal assembly of the disclosure. Any operations including drilling, casing running, drilling while casing, or the like, may benefit from the disclosure described herein. Additionally, any operation requiring fluid flow through a central passageway where one end of the apparatus is stationary and another end both rotates and reciprocates may benefit from this disclosure. In one aspect, when the quill is not engaged by the top drive, at least a portion of the quill and the seal assembly may be in a lowered position. This is due to the pull of gravitational forces on the components. When the top drive is disengaged or not operative, the anti-rotation mechanism, and lower part of the reciprocating seal slide along the conduit 238 to the lower position, or reciprocate downward, away from the mechanical seal and the upper part of the reciprocating seal. This position may be maintained when adding tubulars to or removing them from a tubular string until connection to the top drive shaft is needed to provide torque. In another aspect, the lower part of the reciprocating seal slides along the conduit 238 to an upper position, or reciprocates upwards, toward the mechanical seal and upper part of the reciprocating seal.

After the quill engages the tubular of interest, typically via a threaded connection, to make-up the tubular string and then trip the tubular string into the wellbore, at least a portion of the quill and reciprocating seal assembly are raised as a result of the downward movement of the top drive during tubular handling connection operations. The reciprocating portions slide upward along the conduit 238 so that the space between the lower tubular components, i.e. the quill, anti-rotation mechanism and lower part of the reciprocating seal, and the upper components, i.e. the upper part of the reciprocating and rotating seal 204 and the rotational seal 226. In one aspect of the disclosure, the bearings 250 inhibit or prevent compression of the rotational seal 226. The anti-rotation mechanism 260 may contact or attach to the upper part of the rotating and reciprocating section 204 when the space is compressed fully. The reciprocating portions may slide simultaneously, or alternatively may slide independently of one another. The lower portion of the rotating and reciprocating section 204 and the anti-rotation mechanism 260 may remain operatively connected as the quill and the seal move together. While the reciprocating quill and the reciprocating portions of the seal may all simultaneously rotate while moving along the conduit 238, it may be arranged so that these two motions occur separately from one another. The use of the plurality of bearings 250 reduces or eliminates the amount of vertical force the rotational seal 226, and any mechanical seals thereof, is exposed to as a result of the quill operation.

Once the top drive is engaged, operations may proceed. For example, drilling fluid flows from an inlet into the conduit 238 of the present disclosure, proceeding onto the tubular string within the wellbore. As the fluid enters into the conduit, the top drive enables rotation of the reciprocating seal, the conduit 238, the quill and the drill string. At least a portion of the rotating and reciprocating section 204 as well as the conduit 238 rotate simultaneously with the tubular string.

When operation, such as drilling, is halted, the fluid flow into the conduit may be stopped. The top drive is disengaged and at least a portion of the quill and the rotating and reciprocating section 204 may reciprocate downward along the conduit 238. A new tubular may then be operatively coupled to the quill or one or more tubulars within the tubular string may be removed.

The disclosure encompasses an apparatus, which includes a stationary section operably connected to a drilling fluid inlet and a conduit to allow passage of fluid therethrough, a reciprocating and rotating section operably connected to a tubular and having an extension of the conduit to allow passage of the fluid therethrough, which reciprocating and rotating section reciprocates along a longitudinal axis and rotates in conjunction with the tubular therebelow and the top drive conduit, and rotational seal operably disposed therebetween the stationary and reciprocating and rotating sections adapted at a lower end to permit the reciprocating and rotating section to slide axially even during rotation to permit only rotational motion at an upper end adjacent the stationary section, and having a further extension of the conduit to allow passage of the fluid therebetween.

In view of all of the above and the figures, one of ordinary skill in the art will readily recognize that the present disclosure introduces an apparatus, comprising: a stationary section having a first central fluid passage; a rotating and reciprocating section rotationally coupled to the stationary section to inhibit the ingress and egress of the drilling fluid while permitting relative rotation between the stationary section and the rotating and reciprocating section, the rotating and reciprocating section comprising: a conduit having a second central fluid passage in fluid communication with the first central fluid passage, and a reciprocating portion reciprocatably sealed to the conduit to inhibit the ingress and egress of the drilling fluid while permitting relative reciprocation. In some aspects, the apparatus comprises a rotational seal coupling the stationary section and the rotating and reciprocating section, the rotational coupler inhibiting the ingress and egress of the drilling fluid while permitting relative rotation between the stationary section and the rotating and reciprocating section. In some aspects, the apparatus comprises a reciprocating seal disposed between the conduit and the reciprocating portion, the reciprocating seal inhibiting the ingress and egress of the drilling fluid while permitting relative reciprocating motion between the conduit and the reciprocating portion. In some aspects, the apparatus comprises a drilling quill directly attached to the reciprocating portion. In some aspects, the quill comprises an inner passage in communication with the second central fluid passageway of the rotating and reciprocating section, the inner passage being configured to receive an end of the conduit. In some aspects, the reciprocating portion comprises an anti-rotation mechanism to inhibit or prevent rotation between the conduit and the reciprocating portion. In some aspects, the anti-rotation mechanism comprises at least one of the following: a plurality of splines; a plurality of rods; an annular sealing element; and a tubular body having a non-circular shape. In some aspects, the apparatus comprises one or more piston seals that sealingly engage an outside surface of the conduit. In some aspects, the anti-rotation mechanism prevents rotation or more than a full revolution between the conduit and the reciprocating portion. In some aspects, the anti-rotation mechanism permits relative rotation between the conduit and reciprocating portion to a speed lower than the relative rotation of between the stationary section and the a rotating and reciprocating section. In some aspects, the apparatus comprises a housing at least partially surrounding the stationary section and the rotating and reciprocating section. In some aspects, the housing comprises an access window providing access to the stationary section or the rotating and reciprocating section. In some aspects, the reciprocating portion is a quill connectable to a drilling tubular. In some aspects, the apparatus comprises a supporting structure supporting the rotating and reciprocating section.

The present disclosure also introduces an apparatus, comprising: a rotational seal having a rotating portion and a stationary portion, a fluid passageway portion extending therethrough; a stationary structure operably connected to the stationary portion of the rotational seal and having a fluid passageway extending therethrough; a rotating conduit operably connected to the rotating portion of the rotational seal and having a central fluid passageway extending therethrough, the rotational seal being configured to inhibit the ingress and egress of the drilling fluid while permitting relative rotation between the stationary structure and the rotating conduit; and a reciprocating portion rotatable with the conduit; a reciprocating seal disposed between the conduit and the reciprocating portion to inhibit the ingress and egress of the drilling fluid while permitting relative reciprocation. In some aspects, the reciprocating portion comprises an anti-rotation mechanism to inhibit or prevent rotation between the conduit and the reciprocating portion. In some aspects, the anti-rotation mechanism comprises at least one of the following: a plurality of splines; a plurality of rods; an annular sealing element; and a tubular body having a non-circular shape. In some aspects, the apparatus comprises one or more piston seals that sealing engage an outside surface of the conduit.

The present disclosure also introduces a method comprising: providing a stationary section having a first central fluid passageway; rotating a rotating and reciprocating section with a conduit relative to the stationary section while inhibiting the ingress and egress of a fluid, the conduit having a central fluid passageway; reciprocating a reciprocating portion relative to the conduit inhibiting the ingress and egress of the fluid. In some aspects, the method comprises rotating the rotating and reciprocating section and reciprocating the reciprocating portion simultaneously. In some aspects, the method comprises introducing a fluid through the central passageway to a tubular in a wellbore. In some aspects, the method comprises reciprocating the reciprocating portion towards the stationary section when a top drive engages a tubular.

The present disclosure also introduces an apparatus that includes a first section having a first central fluid passage and operably connected to a drilling fluid inlet and a conduit, a rotating and reciprocating section having a second central fluid passage and operably connected to a tubular, wherein the rotating and reciprocating section reciprocates along a longitudinal axis and rotates in conjunction with the tubular and the conduit, and a third section having a third central fluid passage in fluid communication between the first and second central fluid passages, wherein the third section is operably disposed between the first and rotating and reciprocating sections to permit the rotating and reciprocating section to slide axially even during rotation to permit only rotational motion at an end adjacent the first section. In some aspects, the apparatus further includes a housing that at least partially surrounds the first, second and third sections. In further aspects, the extension of the conduit reciprocates and rotates within the rotating and reciprocating section. In some aspects, the first section includes at least a first portion of a radial mechanical seal member disposed at an end thereof. In further aspects, the third section includes at least a second portion of the radial mechanical seal member disposed at an end thereof and interfacing with the first portion of the radial mechanical seal member. In some aspects the apparatus further includes a plurality of bearings facilitating rotation of the third section. In some aspects, the at least a portion of the rotating and reciprocating section rotates about an axis of rotation. In further aspects, the rotating and reciprocating section includes at least one mechanical seal member seal that at least inhibits leakage of fluid during reciprocation of the rotating and reciprocating section. In further aspects, the mechanical seal member is durable for at least about 500 to 5,000 hours over an average rotational use of about 500 RPMs. In one aspect, the rotating and reciprocating section includes an anti-rotation mechanism to inhibit or prevent rotation between a plurality of components of the rotating and reciprocating section In another aspect, the anti-rotation mechanism comprises at least one of the following: a plurality of splines; a plurality of rods; an annular sealing element; and a tubular body having a non-circular shape. In yet another aspect, the apparatus includes one or more piston seals that provide a sealing engagement between at least two of the plurality of components of the rotating and reciprocating section.

The present disclosure also introduces a method that includes providing a first zone through which a first central fluid passage permits fluid flow therethrough during operation and is operably connected to a fluid inlet; axially reciprocating a second zone having a second central fluid passage and operably connected to a tubular in a direction along the tubular, and concurrently rotating the second zone in association with at least the tubular, and disposing a third zone having a third central fluid passage between the first and second zones to provide fluid communication between the first and second central passages, wherein the third zone has a portion that is constrained to rotational motion where it is adjacent to an opposing portion of the first zone, wherein the third zone cooperates with the axially reciprocating and concurrently rotating second zone. In some aspects, the method further includes operably connecting a conduit to the central fluid passage and the second and third central fluid passages. In other aspects, the method further includes rotating the second central fluid passage simultaneously with the second zone. In a further aspect, the second zone reciprocates substantially perpendicularly to a surface into or from which the tubular may be transferred. In another further aspect, the second zone reciprocates towards the first zone when a top drive engages a tubular. In some aspects, the method further includes sealing a portion of the conduit and a quill that is operably connected to the tubular to inhibit fluid from leaking. In a further aspect, the reciprocating of the at least second zone eliminates an amount of radial friction at least on the portion of the third zone adjacent to the opposing portion of the first zone. In another aspect, the method further includes simultaneously rotating at least the tubular, the second zone, and the second central fluid passage. In a further aspect, a pressure applied to a plurality of threads at an end of the tubular is reduced when a quill is connected between the second zone and the tubular. In another aspect, the method further includes a bearing zone to facilitate rotation of the third zone.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 226 U.S.C. §112, paragraph 6 for any limitations of any of the claims herein, except for those in which the claim expressly uses the word "means" together with an associated function.

What is claimed is:

1. An apparatus, comprising:

a stationary section having a first central fluid passage;

a rotating and reciprocating section rotationally coupled to the stationary section to inhibit the ingress and egress of drilling fluid while permitting relative rotation between the stationary section and the rotating and reciprocating section, the rotating and reciprocating section comprising:

a conduit having a second central fluid passage in fluid communication with the first central fluid passage, and a reciprocating portion reciprocatably sealed to the conduit to inhibit the ingress and egress of the drilling fluid while permitting relative reciprocation; and a rotational seal having a rotating portion in contact with a stationary portion of the rotational seal, wherein the rotational seal couples and fluidically seals the stationary section and the rotating and reciprocating section.

2. The apparatus of claim 1, wherein the rotational seal inhibits the ingress and egress of the drilling fluid while permitting relative rotation between the stationary section and the rotating and reciprocating section.

3. The apparatus of claim 1, comprising:

a reciprocating seal disposed between the conduit and the reciprocating portion, the reciprocating seal inhibiting the ingress and egress of the drilling fluid while permitting relative reciprocating motion between the conduit and the reciprocating portion.

4. The apparatus of claim 1, comprising a drilling quill directly attached to the reciprocating portion.

5. The apparatus of claim 4, wherein the quill comprises an inner passage in communication with the a second central fluid passage of the rotating and reciprocating section, the inner passage being configured to receive an end of the conduit.

6. The apparatus of claim 1, wherein the reciprocating portion comprises an anti-rotation mechanism to inhibit or prevent rotation between the conduit and the reciprocating portion.

7. The apparatus of claim 6, wherein the anti-rotation mechanism comprises at least one of the following:

a plurality of splines;

a plurality of rods;

an annular sealing element; and a tubular body having a non-circular shape.

8. The apparatus of claim 6, further comprising one or more piston seals that sealingly engage an outside surface of the conduit.

9. The apparatus of claim 6, wherein the anti-rotation mechanism prevents rotation of more than a full revolution between the conduit and the reciprocating portion.

10. The apparatus of claim 6, wherein the anti-rotation mechanism permits relative rotation between the conduit and the reciprocating portion to a speed lower than the relative rotation of the stationary section and the rotating and reciprocating section.

11. The apparatus of claim 1, comprising a housing at least partially surrounding the stationary section and the rotating and reciprocating section.

12. The apparatus of claim 11, wherein the housing comprises an access window providing access to the stationary section or the rotating and reciprocating section.

13. The apparatus of claim 1, wherein the reciprocating portion comprises a quill connectable to a drilling tubular.

14. The apparatus of claim 1, further comprising a supporting structure supporting the rotating and reciprocating section.

15. An apparatus, comprising:

a rotational seal having a rotating portion contacting a stationary portion, and a fluid passageway portion extending therethrough and fluidically sealed by the contact between the rotating portion and the stationary portion;

a stationary structure operably connected to the stationary portion of the rotational seal and having a fluid passageway extending therethrough;

a rotating conduit operably connected to the rotating portion of the rotational seal and having a central fluid passageway extending therethrough, the rotational seal being configured to inhibit the ingress and egress of drilling fluid while permitting relative rotation between the stationary structure and the rotating conduit;

a reciprocating portion rotatable with the conduit; and a reciprocating seal disposed between the conduit and the reciprocating portion to inhibit the ingress and egress of the drilling fluid while permitting relative reciprocation.

16. The apparatus of claim 15, wherein the reciprocating portion comprises an anti-rotation mechanism to inhibit or prevent rotation between the conduit and the reciprocating portion.

17. The apparatus of claim 16, wherein the anti-rotation mechanism comprises at least one of the following:

a plurality of splines;

a plurality of rods;

an annular sealing element; and a tubular body having a non-circular shape.

18. The apparatus of claim 16, wherein the reciprocating seal comprises one or more piston seals that sealing engage an outside surface of the conduit.

19. The apparatus of claim 15, wherein a first flange of a rotating and reciprocating section is supported by a support structure of a support housing.

20. A method comprising:

providing a stationary section having a first central fluid passageway;

rotating a rotating and reciprocating section with a conduit relative to the stationary section while inhibiting the ingress and egress of a fluid with a rotational seal having a rotating portion contacting a stationary portion, the conduit having a central fluid passageway fluidically sealed by the contact between the rotating portion and the stationary portion; and reciprocating a reciprocating portion relative to the conduit inhibiting the ingress and egress of the fluid.

21. The method of claim 20, further comprising rotating the rotating and reciprocating section and reciprocating the reciprocating portion simultaneously.

22. The method of claim 20, comprising introducing a fluid through the central passageway to a tubular in a wellbore.

23. The method of claim 20, comprising reciprocating the reciprocating portion towards the stationary section when a top drive engages a tubular.

* * * * *